US007278366B2

(12) United States Patent
Cooper

(10) Patent No.: US 7,278,366 B2
(45) Date of Patent: Oct. 9, 2007

(54) METHOD AND APPARATUS FOR INCREASING SAIL EFFICIENCY

(76) Inventor: Stephanie N. Cooper, 5012 Sharynne La., Torrance, CA (US) 90505

( * ) Notice: Subject to any disclaimer, the term of this patent is extended or adjusted under 35 U.S.C. 154(b) by 0 days.

(21) Appl. No.: 11/372,826

(22) Filed: Mar. 10, 2006

(65) Prior Publication Data

US 2006/0201409 A1 Sep. 14, 2006

Related U.S. Application Data

(60) Provisional application No. 60/661,252, filed on Mar. 11, 2005.

(51) Int. Cl.
*B63H 9/10* (2006.01)

(52) U.S. Cl. ..... 114/98; 114/102.13

(58) Field of Classification Search ..... 114/97, 114/98, 102.12, 102.13, 102.14, 102.16, 102.18, 114/102.21
See application file for complete search history.

(56) References Cited

U.S. PATENT DOCUMENTS 3,720,180 A * 3/1973 Stangeland ..... 114/102.13
3,820,493 A * 6/1974 Amick ..... 114/39.29
4,347,799 A * 9/1982 Moriarty ..... 114/102.15
4,951,589 A * 8/1990 Pfeffer ..... 114/102.13
5,038,699 A * 8/1991 Cochran et al. ..... 114/97

* cited by examiner

*Primary Examiner*—Sherman Basinger
(74) *Attorney, Agent, or Firm*—Gates & Cooper LLP

(57) ABSTRACT

A method and apparatus for increasing sail efficiency is disclosed. The apparatus comprises a second sail, disposed in a second plane substantially perpendicular to the first plane, wherein the second sail is disposed proximate a periphery of the first sail.

5 Claims, 9 Drawing Sheets

METHOD AND APPARATUS FOR INCREASING SAIL EFFICIENCY

This application claims benefit of U.S. Provisional Patent Application No. 60/661,252, entitled "METHOD AND APPARATUS FOR INCREASING SAIL EFFICIENCY," by Stephanie N. Cooper, filed Mar. 11, 2005, which application is hereby incorporated by reference herein.

BACKGROUND OF THE INVENTION

1. Field of the Invention

The present invention relates to sailboats, and in particular to a system and method for improving the efficiency of the sails used on such sailboats.

2. Description of the Related Art

Sailing is a sport popular the world over. Many enthusiasts participate in sailboat races, where the difference between winning and losing can amount to mere seconds. Typically, the outcome of these races is determined by the skill of the captain and the crew to select the proper course, the best sail combination and to deploy the sails properly to best utilize the available wind. These factors are even important in non-competitive sailing, as they can have a substantial effect on the vessel's speed through the water.

What is needed is an method and apparatus for increasing the efficiency of a sail. What is also needed is a means for deploying this efficiency-increasing apparatus. The present invention satisfies that need.

SUMMARY OF THE INVENTION

To address the requirements described above, the present invention discloses a method and apparatus for increasing sail efficiency. The apparatus is typically for use with a first sail disposed in a first plane between a mast and a boom, and comprises a second sail, disposed in a second plane substantially perpendicular to the first plane, wherein the second sail is disposed proximate a periphery of the first sail.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which is shown, by way of illustration, several embodiments of the present invention. It is understood that other embodiments may be utilized and structural changes may be made without departing from the scope of the present invention.

Figure 1A:
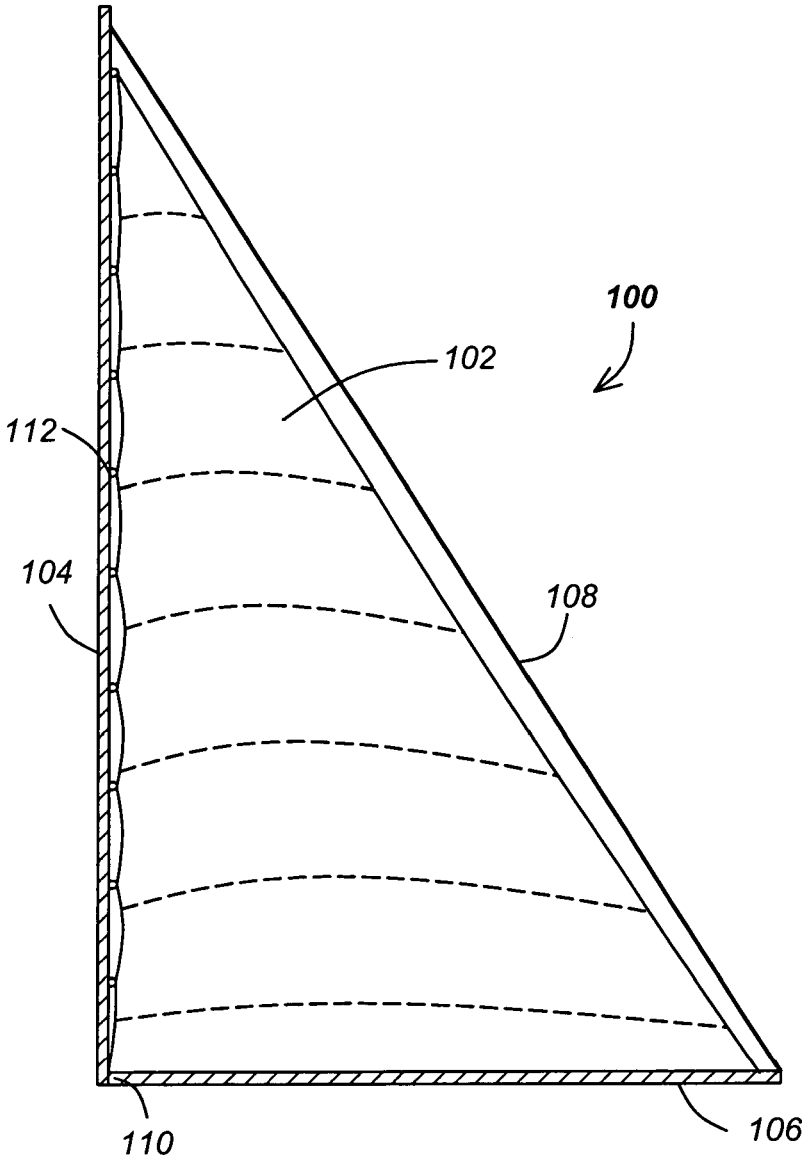
FIG. 1A PRIOR ART
FIG. 1A is a diagram showing side view of an exemplary prior art sail deployed between a mast and a boom.
Figure 1B:
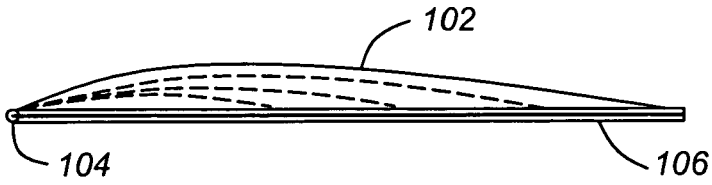
FIG. 1B PRIOR ART
FIG. 1B is a diagram showing a top view of the sail shown in FIG. 1A.

FIGS. 1A and 1B are diagrams illustrating a typical prior art sail system 100. The sail system 100 comprises a mainsail 102, which is held in place by a attachment to a mast 104 and a boom 106 whereby the boom is rotatable in a plane perpendicular to the mast 104, allowing the mainsail 102 to be rotated about the mast 104 for optimal performance. The boom 106 is rotatably affixed to the mast 104 using a rotatable joint 110, and is held in position in the vertical plane by boom cable 108, which is attached to the top of the mast 104 and the end of the boom 106 distal from the mast 104.

The mainsail 102 can be affixed to the mast in a number of ways known in the art. For illustrative purposes, the mainsail 102 shown in FIG. 1 is affixed to the mast 104 by use of attachment loops 112, which typically slide along a track within the mast 104. The mainsail 102 is affixed to the attachment loops 122 (for example, via grommets), thus attaching the mainsail 102 to the mast 104 in a way that permits the mainsail 102 to be stored by wrapping it around the boom, and deployed by use of a cable and pulley near the top of the mast 104. The mainsail 102 is attached to the boom using similar techniques known in the art.

Figure 1C:
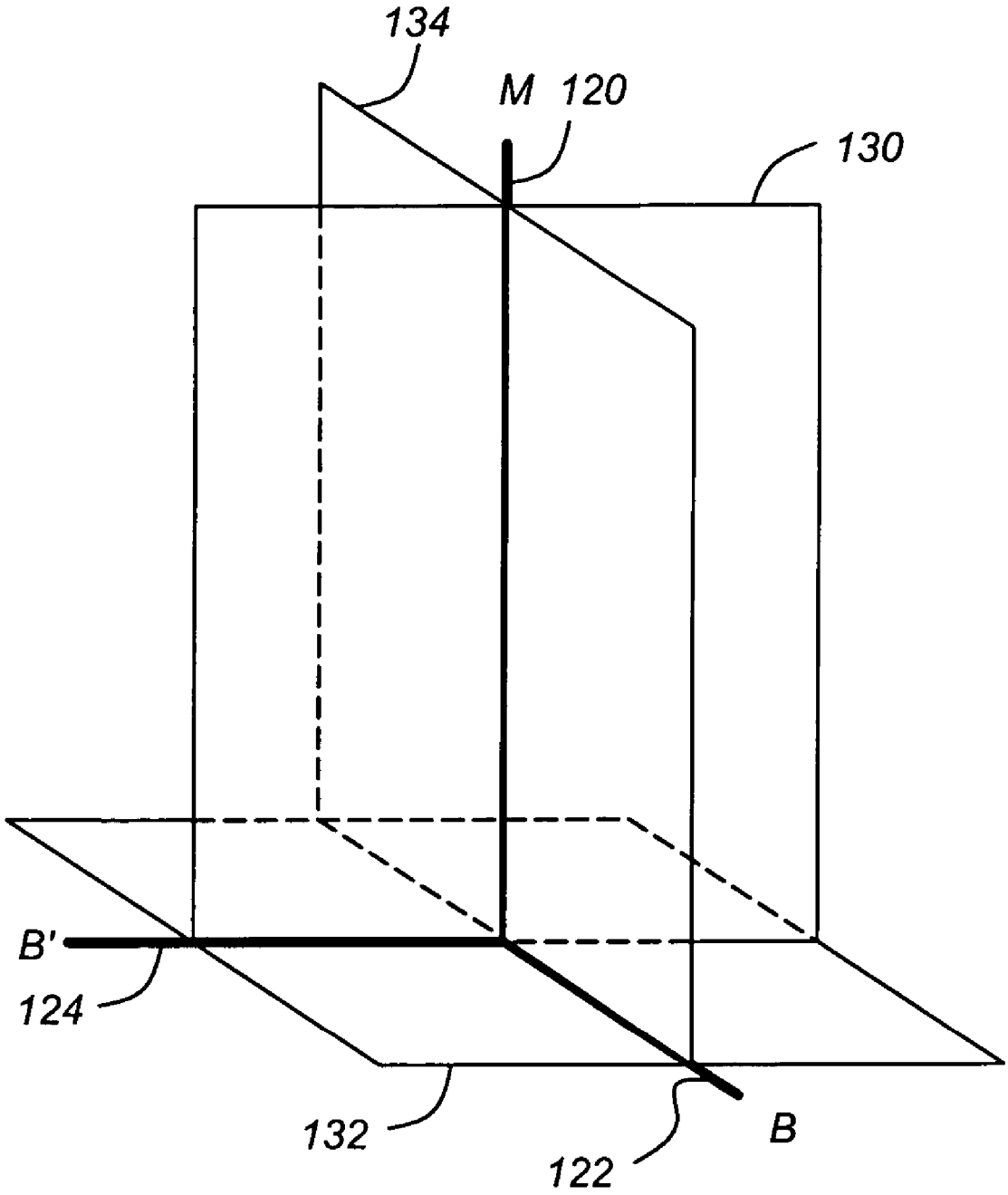
FIG. 1C is a diagram showing the spatial relationships that will be used to describe embodiments of the invention.

FIG. 1C is a diagram showing the spatial relationships that will be used to describe embodiments of the invention. The mast 104 is co-linear with the M axis 120, and the boom 106 is collinear with the B axis 122. The B axis 122 is perpendicular to the M axis 120, and the mainsail 102 is disposed in first plane 134 which is defined by the M axis 120 and the B axis 122. Axis B' 124 is perpendicular to both the M axis 120 and the B axis 122. Axes B 122 and B' 124 define a second plane 132, while axes M 120 and B' 124 define third plane 130.

Figure 2A:
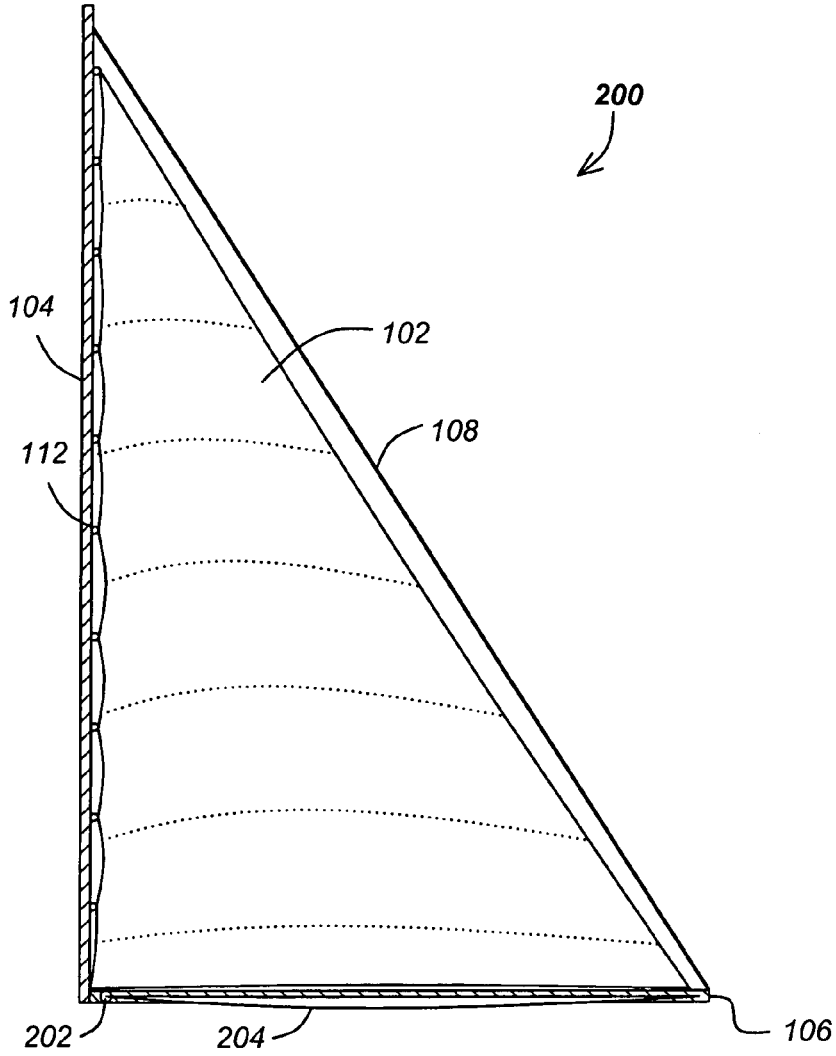
FIG. 2A is a diagram showing a side view of one embodiment of the present invention.
Figure 2B:
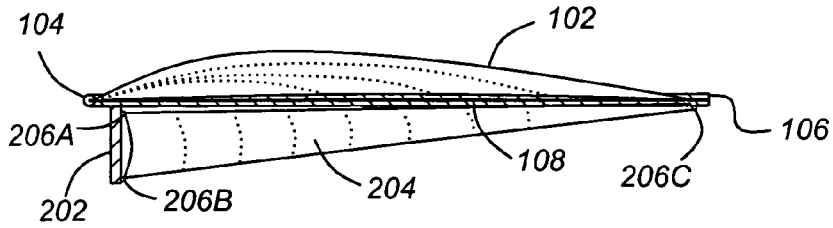
FIG. 2B is a diagram showing a top view of the embodiment of the present invention illustrated in FIG. 2A.
Figure 2C:
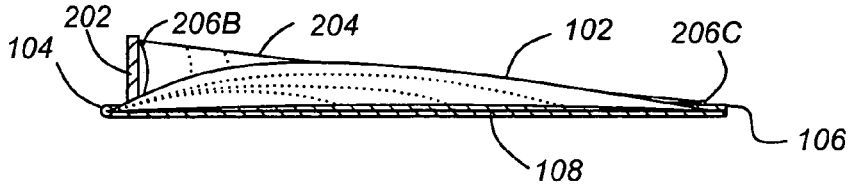
FIG. 2C is a diagram showing a top view of another embodiment of the present invention.

FIGS. 2A-2C are diagrams illustrating one embodiment of an improved sail system 200. The improved sail system 200 (hereinafter alternatively referred to simply as the sail system 200) also comprises a mainsail 102 disposed (e.g. suspended) in a plane defined by the mast 104 and the boom 106 (e.g. the first plane 134 shown in FIG. 1). Unlike the prior art sail system 100, the illustrated sail system 200 includes a second sail 204 (hereinafter alternatively referred to in its various embodiments as the auxiliary sail 204).

The second sail 204 is disposed in a plane that is perpendicular the plane 130 defined by the mast 104 and the boom 106 (i.e. any plane co-planar with plane 132). In the embodiment shown, the second sail 204 is suspended by connection to the boom 106 and a boomlet 202. The second sail 204 can be connected to the boom and/or boomlet 202 by means known in the art, including via the use of grommets disposed in the second sail and/or tie down points 206A-206C disposed on the boomlet 202 and the boom 106. The second sail 204 serves to increase the efficiency of the mainsail 102 by directing the laminar airflow over the mainsail 102.

In FIG. 2B, the second sail 204 is disposed on the windward side of the mainsail 102. In FIG. 2C, the second sail 204 is disposed on the leeward side of the mainsail 102. To decrease wind resistance, the boomlet 202 may be made non-circular (e.g. ovoid, teardrop shaped) in cross section.

Figure 3A:
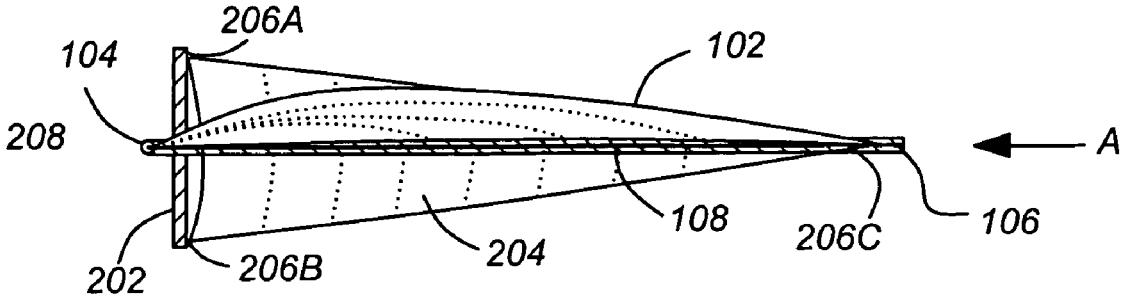
FIG. 3A is a diagram showing a top view of a two-sided embodiment of the present invention in which the boomlet supporting the auxiliary sail is disposed proximate the mast.
Figure 3B:
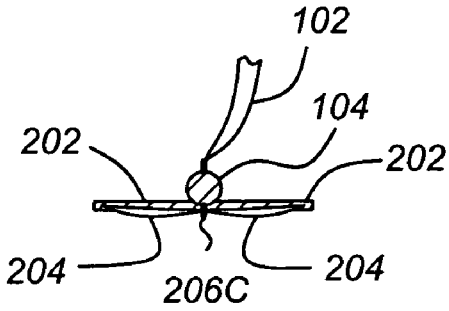
FIG. 3B is a diagram showing the embodiment illustrated in FIG. 3A viewed from the perspective of location "A"

FIGS. 3A and 3B are diagrams illustrating another embodiment of the invention, in which the second sail 204 is disposed on both sides (leeward and windward) of the mainsail 102. Again, in this embodiment, the second sail 204 is suspended by a boomlet 202, but in this case, the boomlet 202 extends to both sides of the mainsail 102. This embodiment further increases the efficiency of the mainsail 102 and provides essentially the same functionality regardless of the rotation of the boom about the mast. While FIGS. 3A and 3B illustrate the boomlet 202 disposed below the boom 104, the boomlet 202 may be disposed anywhere as necessary to support the second sail 204 in a plane that is coplanar with plane 132

Figure 4A:
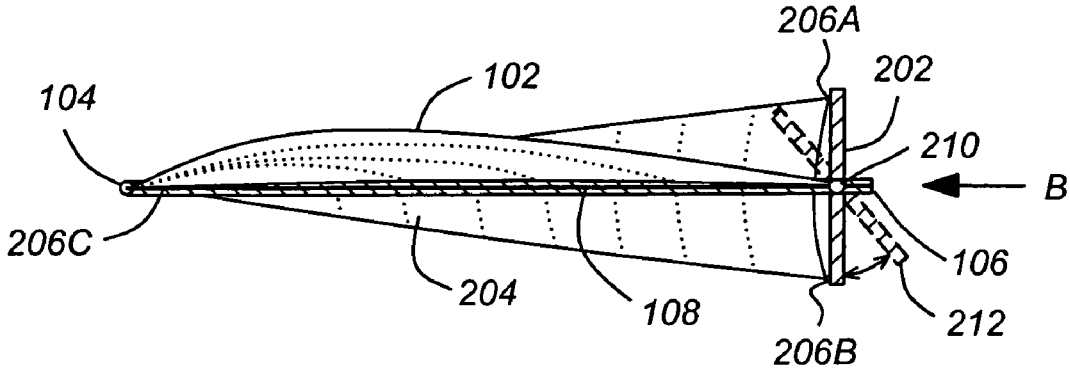
FIG. 4A is a diagram showing a top view of another two-sided embodiment of the present invention in which the boomlet supporting the auxiliary sail is disposed distal from the mast.
Figure 4B:
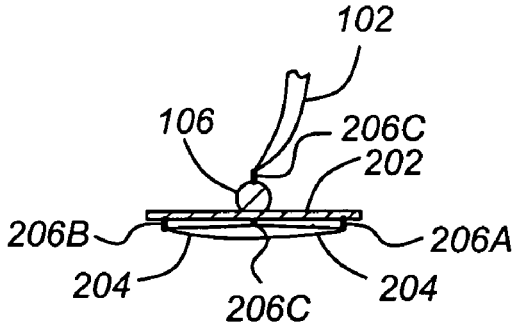
FIG. 4B is a diagram showing the embodiment illustrated in FIG. 4A viewed from the perspective of location "B"

FIGS. 4A and 4B illustrate an embodiment similar to that which is illustrated in FIGS. 3A and 3B, except the boomlet 202 is disposed distal from the mast 202 toward the stern of the craft. Also, FIG. 4A discloses an embodiment in which the boomlet 202 is coupled to the boom 106 via a rotatable joint 210, thus permitting the second sail 204 to be easily deployed or undeployed by 90 degree rotation (of which an intermediate position is shown as 212). This rotatable boomlet option can also be implemented with the boomlet 202 adjacent the mast, with a pulley structure such as that which is described below.

Figure 5A:
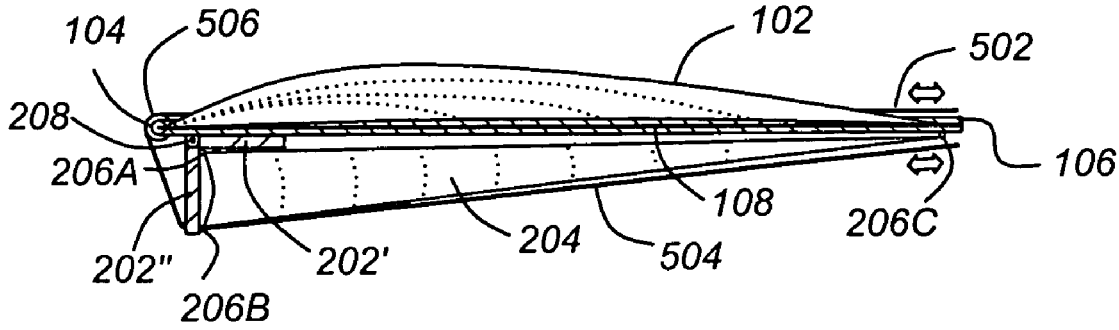
FIG. 5A is a diagram showing a top view of a selectably deployable embodiment of the auxiliary sail and boomlet.

FIG. 5A illustrates an embodiment in which the second sail 204 is deployable and stowable by use of a movable boomlet 202. In the embodiment shown in FIG. 5A, the boomlet 202 (shown in deployed position) can be disposed in a stowed position 202'. In this embodiment, the boomlet 202 rotates around an axis emerging perpendicularly from the drawing—that is—an axis parallel to the mast and perpendicular to the boom 106—as shown. This is implemented by use of a joint 208 disposed at the end of the boomlet 202 closest to the boom 106. Deployment of the boomlet 202 (and hence, the second sail 204) can be effected by tensioning the first cable 502, and can be brought back to the stowed position 202' via tensioning of the second cable 504. This is accomplished by application of a pulley 506 rotating about an axis parallel to the mast 104. In the illustrated embodiment, the pulley 506 rotates about an axis collinear with the mast 104.

Figure 5B:
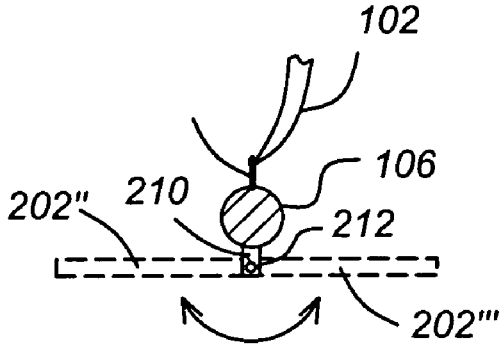
FIG. 5B is a diagram showing a rear view of a further embodiment of the auxiliary sail that is deployable to both sides of the main sail.

FIG. 5B illustrates another embodiment in which the second sail is deployable on opposite sides of the boom 106. This is implemented with a joint 212 having an axis of rotation that is parallel to the boom 108. The joint 212 or associated structures on member 210 and the boomlet 202 may include provision for affixing the boomlet 202 in first position 202" or second position 202'". Such provision may include interlocking structures on the boomlet 202 and the member 210.

Figure 6A:
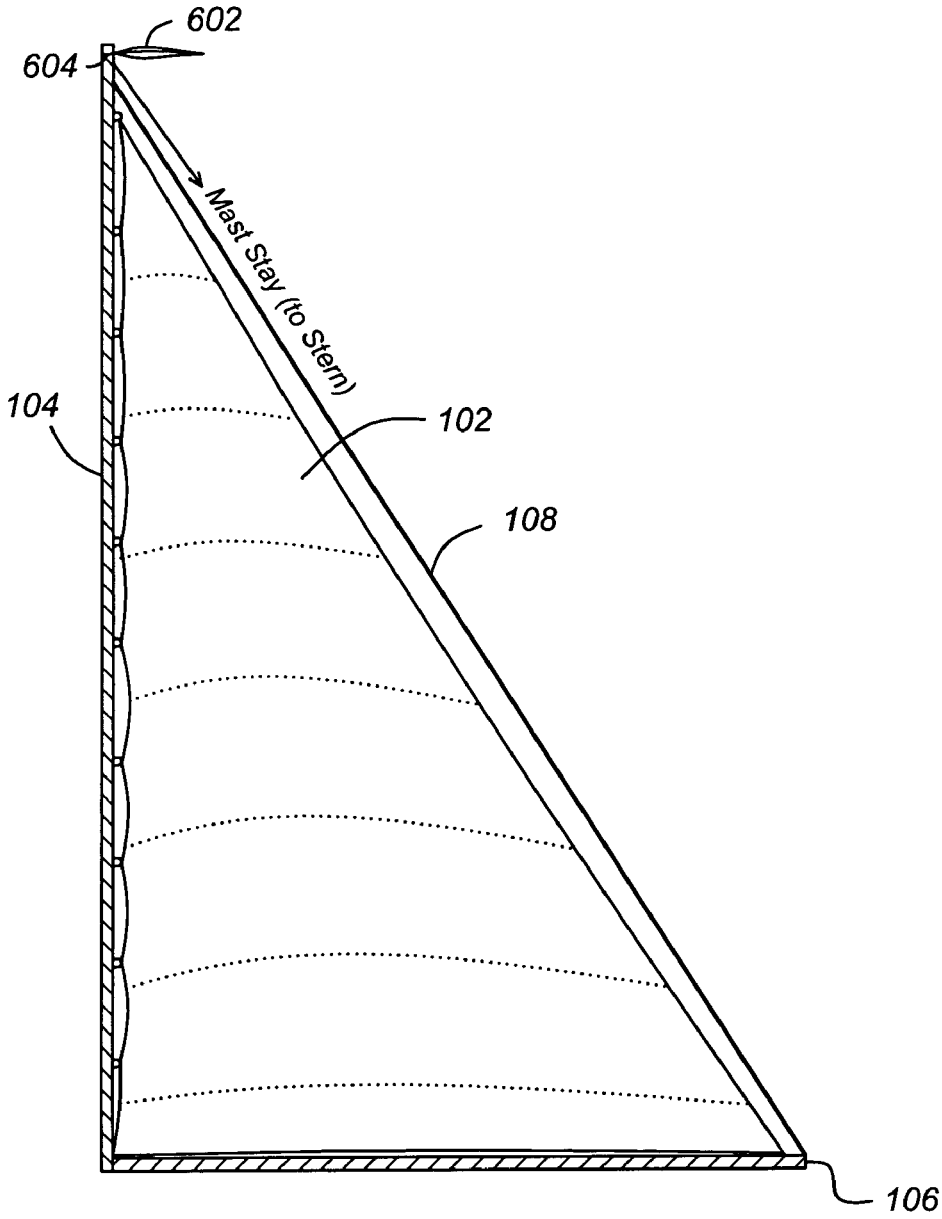
FIG. 6A is a diagram showing another embodiment of the present invention using a self-supporting auxiliary sail structure.
Figure 6B:
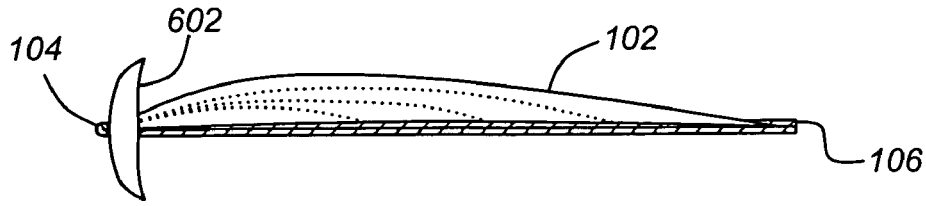
FIG. 6B is a diagram showing a top view of the embodiment illustrated in FIG. 6A.

FIGS. 6A and 6B are diagrams of another embodiment of the present invention. In this embodiment, the second sail 602 is proximate the top of the mast 104, improving airflow over the upper region of the mainsail 102. Also, in this embodiment, the second sail 602 is constructed of a shape-retaining material such as a plastic, so that structures such as the boomlet 202 are not required.

The second sail 602 can be affixed to the mast 104 with a rotatable joint 604 such that the second sail 602 can rotate about the mast 104 axis, or may be fixed to the mast 104. The rotatable joint 604 can allow the second sail 602 to always point into the wind, regardless of the boom 106 position, or may rotate along with the boom 106, possibly by affixation to the boom cable 108. Although the second sail 602 shown in FIGS. 6A and 6B is wing-shaped, other shapes can also be used.

Figure 7A:
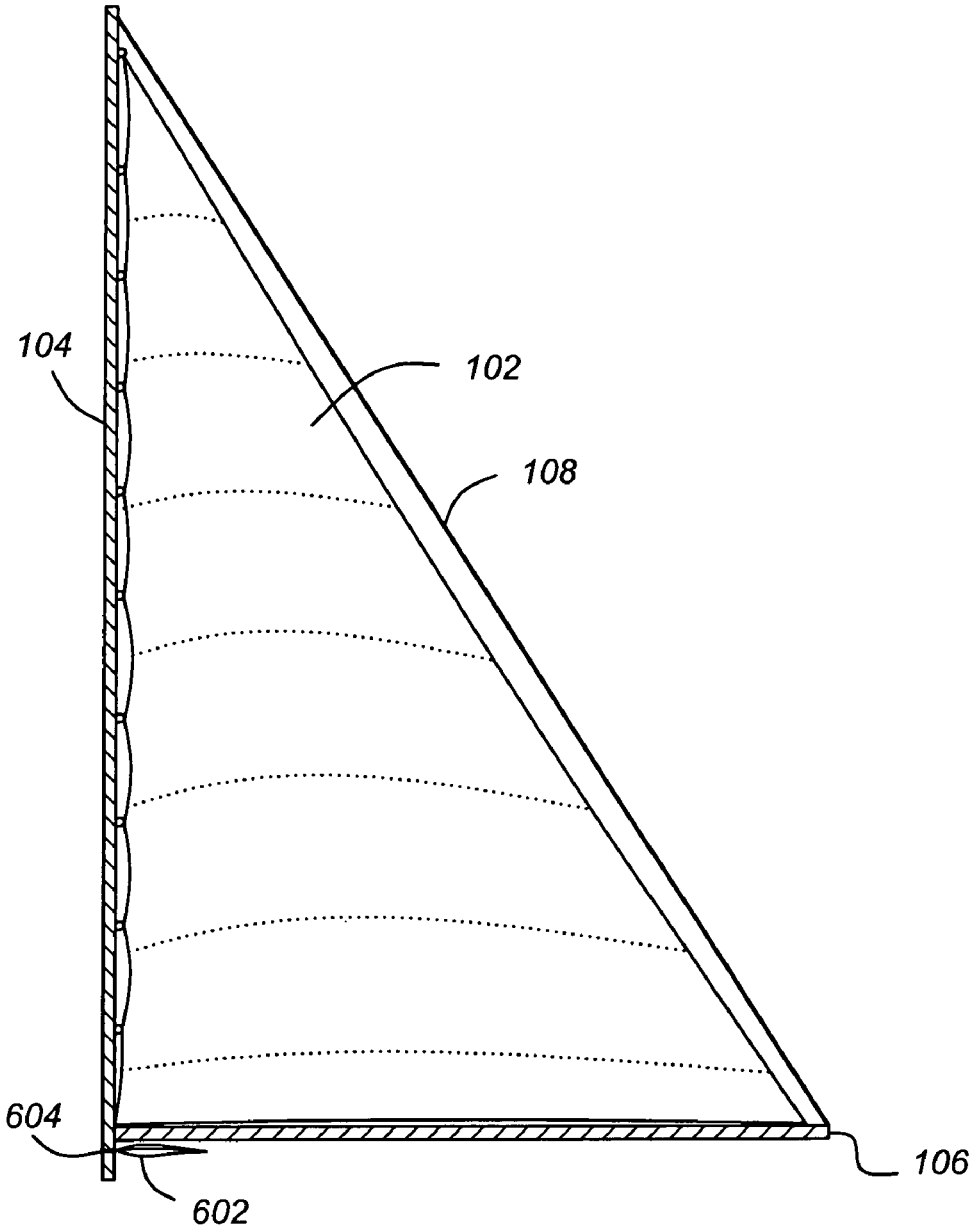
FIG. 7A is a diagram showing an embodiment of the self-supporting auxiliary sail structure disposed proximate the base of the mast.
Figure 7B:
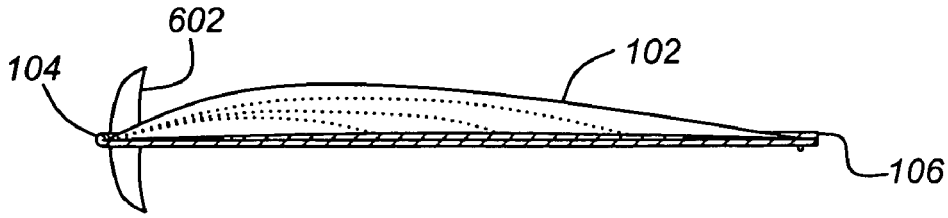
FIG. 7B is a diagram showing a top view of the embodiment illustrated in FIG. 7A.

FIGS. 7A and 7B are diagrams showing an embodiment of the present invention wherein the second sail 602 is affixed to the mast proximate the boom 106. As was the case with the embodiment shown in FIGS. 6A and 6B, the second sail 602 may be rotatable about the mast or non-rotatable. The second sail 602 may be made to rotate with the boom 106 via appropriate affixment to the boom 106.

Figure 8A:
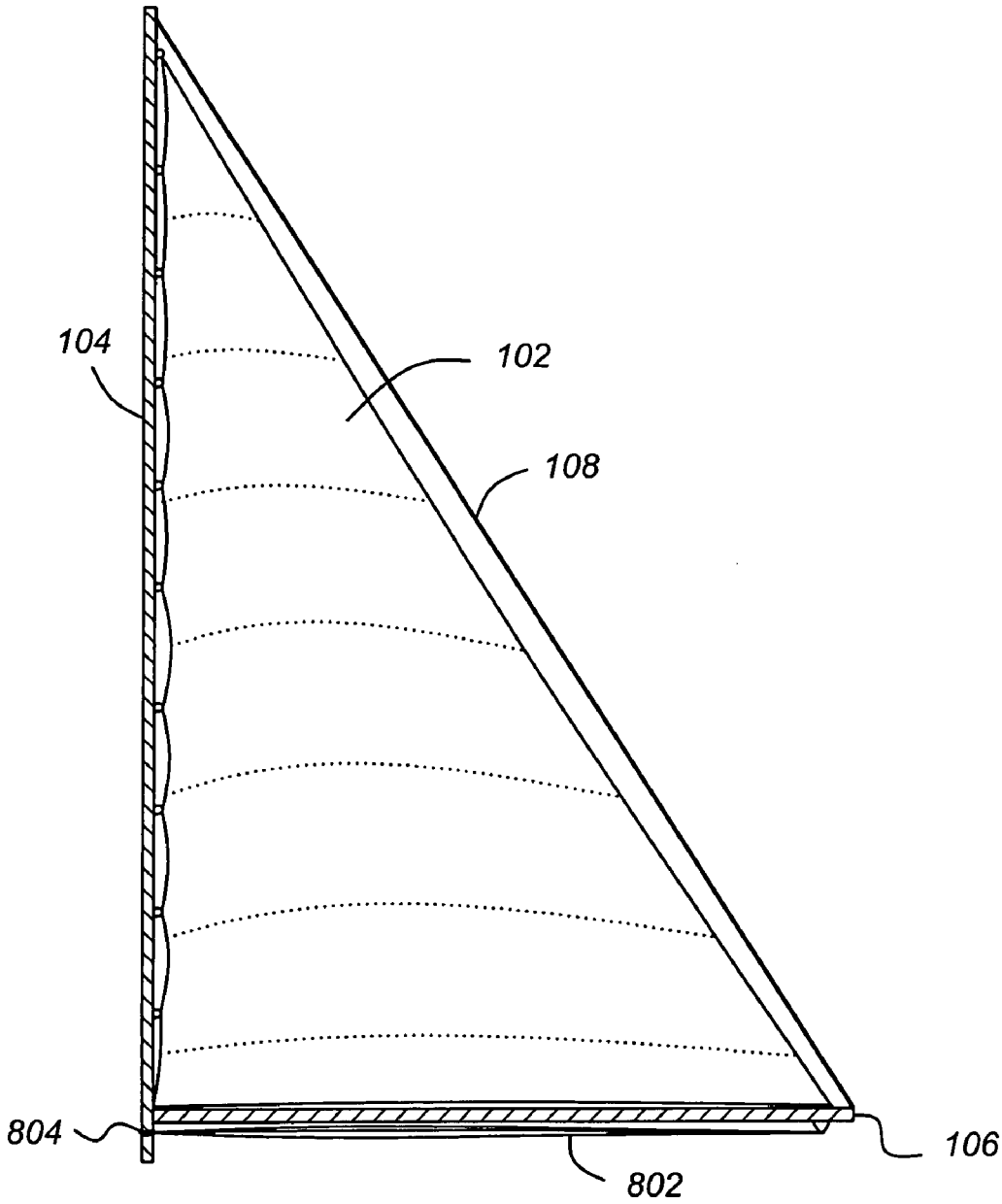
FIG. 8A is a diagram showing an embodiment of the self-supporting auxiliary sail structure having an elongated shape.
Figure 8B:
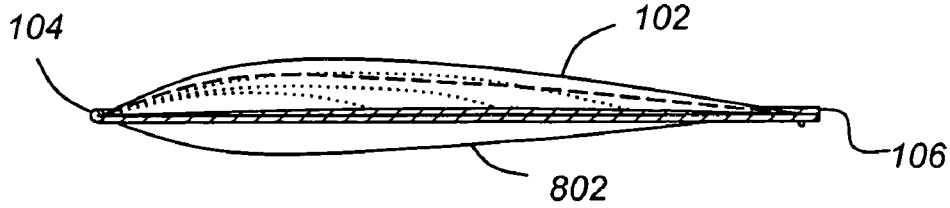
FIG. 8B is a diagram showing a top view of the embodiment illustrated in FIG. 8A.

FIG. 8A and 8B are diagrams showing another embodiment of the present invention. In this embodiment, the second sail 802 (which may also be constructed of a shape-retaining material) extends a greater distance along the boom 106 to provide increased influence over the airflow over the mainsail 102. In the illustrated embodiment, the second sail 802 is also teardrop shaped when viewed from above.

CONCLUSION

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching. For example, although the embodiments disclosed above illustrate the use of the second sail either above or below the mainsail, it is also envisioned that a second sail can be placed in both locations. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for use with a mainsail disposed in a first plane between a mast and a boom, comprising:

a boomlet disposed substantially perpendicular to the boom and the mass;

a second sail, coupled to the boomlet and disposed longitudinally along the boom in a second plane substantially perpendicular to the first plane and disposed on a leeward and windward side of the mainsail;

a pulley, rotatable around an axis parallel to the mast;

a first tensioner, affixed to the boomlet distal from the boom and extending from the boomlet through the pulley and to the boom distal from the mast;

a second tensioner, affixed to the boomlet distal from the boom and extending from the boomlet to the boom distal from the mast; and wherein the boomlet is rotatably affixed to the boom, permitting boomlet rotation in the second plane.

2. The apparatus of claim 1, wherein the second sail is removably affixed to the boomlet and the boom.

3. The apparatus of claim 1, wherein the boomlet is disposed proximate the mast.

4. The apparatus of claim 1, wherein the boomlet is disposed distal from the mast and is rotatably affixed to the boom, permitting boomlet rotation in the second plane.

5. An apparatus for use with a mainsail disposed in a first plane between a mast and a boom, comprising:

a boomlet, disposed substantially perpendicular to the boom and the mast;

a second sail, coupled to the boomlet and disposed longitudinally along the boom in a second plane substantially perpendicular to the first plane;

a pulley, rotatable around an axis parallel to the mast;

a first tensioner, affixed to the boomlet distal from the boom and extending from the boomlet through the pulley and to the boom distal from the mast; and a second tensioner, affixed to the boomlet distal from the boom and extending from the boomlet to the boom distal from the mast;

wherein the boomlet rotates around an axis parallel to the mast and perpendicular to the boom between a stowed position and a deployed position.

* * * * *